US005538164A

United States Patent [19]

Rivas

[11] Patent Number: 5,538,164

[45] Date of Patent: Jul. 23, 1996

[54] APPARATUS FOR SPRAYING A DISABLING LIQUID AT AN ATTACKER

[76] Inventor: Joseph F. Rivas, 11377 Osborne Pl., Unit 23, Lake View Terrace, Calif. 91342

[21] Appl. No.: 355,534

[22] Filed: Dec. 14, 1994

[51] Int. Cl.[6] ..... B67D 5/33

[52] U.S. Cl. ..... 222/153.04; 222/175; 222/207; 222/212

[58] Field of Search ..... 222/78, 79, 175, 222/192, 207, 212, 209, 561, 153.04, 153.14, 556; 224/148; 237/529, 154; 446/475

[56] References Cited

U.S. PATENT DOCUMENTS

| | | | |
|---|---|---|---|
| 1,885,180 | 11/1932 | Cameron | 222/175 |
| 2,192,082 | 2/1940 | Hunicke | 222/175 |
| 3,643,704 | 2/1972 | Carr | 222/561 |
| 4,629,098 | 12/1986 | Eger | 222/175 |
| 5,072,856 | 12/1991 | Kimble | 222/175 |
| 5,088,624 | 2/1992 | Hackett et al. | 222/78 |

FOREIGN PATENT DOCUMENTS

| | | | |
|---|---|---|---|
| 39534 | 9/1973 | Australia | 239/529 |

*Primary Examiner*—Andres Kashnikow
*Assistant Examiner*—Philippe Derakshani

[57] ABSTRACT

An apparatus for spraying a disabling liquid at an attacker comprising a dispenser for a quantity of a liquid capable of disabling an attacker, the dispenser being fabricated in an oval configuration with a hollow interior containing a liquid and with a discharge opening formed in one side thereof, the dispenser also including an aperture for the feeding of additional fluid thereto; a valve assembly located within the dispenser; a reservoir of additional fluid; and a tube coupling the reservoir with the dispenser for supplying additional fluid from the reservoir to the dispenser.

3 Claims, 4 Drawing Sheets

APPARATUS FOR SPRAYING A DISABLING LIQUID AT AN ATTACKER

BACKGROUND OF THE INVENTION

1. Field of the Invention

The present invention relates to an apparatus for spraying a disabling liquid at an attacker and more particularly pertains to protecting oneself through the dispensing of a readily accessible liquid into the face of the attacker.

2. Description of the Prior Art

The use of devices for spraying a disabling liquid at an attacker through a wide variety of devices and configurations is known in the prior art. More specifically, devices for spraying a disabling liquid at an attacker through a wide variety of devices and configurations heretofore devised and utilized for the purpose of protecting oneself through spraying disabling liquids at an attacker are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,446,990 a self-defense spray device.

U.S. Pat. No. 4,511,062 discloses canisters for pressurized gas and personal security devices utilizing same.

U.S. Pat. No. 4,624,389 discloses a method of personal self-defense.

U.S. Pat. No. 5,000,347 discloses a method for dispensing a protective fluid.

U.S. Pat. No. 5,065,904 discloses a personal protection device.

In this respect, the apparatus for spraying a disabling liquid at an attacker according to the present invention substantially departs from the conventional concepts and designs of the prior art, and in doing so provides an apparatus primarily developed for the purpose of protecting oneself through the dispensing of a readily accessible liquid into the face of the attacker.

Therefore, it can be appreciated that there exists a continuing need for a new and improved apparatus for spraying a disabling liquid at an attacker which can be used for protecting oneself through the dispensing of a readily accessible liquid into the face of the attacker. In this regard, the present invention substantially fulfills this need.

SUMMARY OF THE INVENTION

In view of the foregoing disadvantages inherent in the known types of devices for spraying a disabling liquid at an attacker through a wide variety of devices and configurations now present in the prior art, the present invention provides an improved apparatus for spraying a disabling liquid at an attacker. As such, the general purpose of the present invention, which will be described subsequently in greater detail, is to provide a new and improved apparatus for spraying a disabling liquid at an attacker and method which has all the advantages of the prior art and none of the disadvantages.

To attain this, the present invention essentially comprises a new and improved apparatus for spraying a disabling liquid at an attacker comprising, in combination, a dispenser for a quantity of a liquid capable of disabling an attacker, the dispenser being fabricated in an oval configuration with a hollow interior containing a liquid and with a discharge opening formed in one side thereof, the dispenser also including an aperture for the feeding of additional fluid thereto; a valve assembly located within the dispenser, the valve assembly including a plate positionable over the interior of the opening with adjacent surfaces adapted to frictionally retain the gate in position over the opening to preclude its dispensing, the gate also having a lock positionable adjacent the interior wall of the dispenser in proximity to the opening whereby depressing of the center of the device of the dispenser adjacent the opening will move the lock to urge the gate away from the opening and thereby force fluid through the opening toward the attacker; a reservoir of additional fluid; a tube coupling the reservoir with the dispenser for supplying additional fluid from the reservoir to the dispenser; disconnectable straps secured to the dispenser and to the reservoir and to the tube for removably coupling the reservoir tube and dispenser to the arm of a wearer with the reservoir adjacent the shoulder of a wearer and the dispenser in the hand of the wearer; and a sliding gate valve positioned in the flow of fluid adjacent to the interface between the reservoir and the tube, the gate positionable in a first orientation to preclude the flow of fluid through the tube and a second orientation wherein an aperture of the gate is in alignment with the tube to allow the dispensing of fluid from the reservoir to the dispenser.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for spraying a disabling liquid at an attacker which has all the advantages of the prior art devices for spraying a disabling liquid at an attacker through a wide variety of devices and configurations and none of the disadvantages.

It is another object of the present invention to provide a new and improved apparatus for spraying a disabling liquid at an attacker which may be easily and efficiently manufactured and marketed.

It is further object of the present invention to provide a new and improved apparatus for spraying a disabling liquid at an attacker which is durable and reliable constructions.

An even further object of the present invention is to provide a new and improved apparatus for spraying a disabling liquid at an attacker which is susceptible of a low cost of manufacture with regard to both materials and labor, and which accordingly is then susceptible of low prices of sale to the consuming public, thereby making such apparatus for spraying a disabling liquid at an attacker economically available to the buying public.

Still yet another object of the present invention is to provide a new and improved apparatus for spraying a disabling liquid at an attacker which provides in the apparatuses and methods of the prior art some of the advantages thereof, while simultaneously overcoming some of the disadvantages normally associated therewith.

Still another object of the present invention is to protect oneself through the dispensing of a readily accessible liquid into the face of the attacker.

Lastly, it is an object of the present invention to provide a new and improved apparatus for spraying a disabling liquid at an attacker comprising a dispenser for a quantity of a liquid capable of disabling an attacker, the dispenser being fabricated in an oval configuration with a hollow interior containing a liquid and with a discharge opening formed in one side thereof, the dispenser also including an aperture for the feeding of additional fluid thereto; a valve assembly located within the dispenser; a reservoir of additional fluid; and a tube coupling the reservoir with the dispenser for supplying additional fluid from the reservoir to the dispenser.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
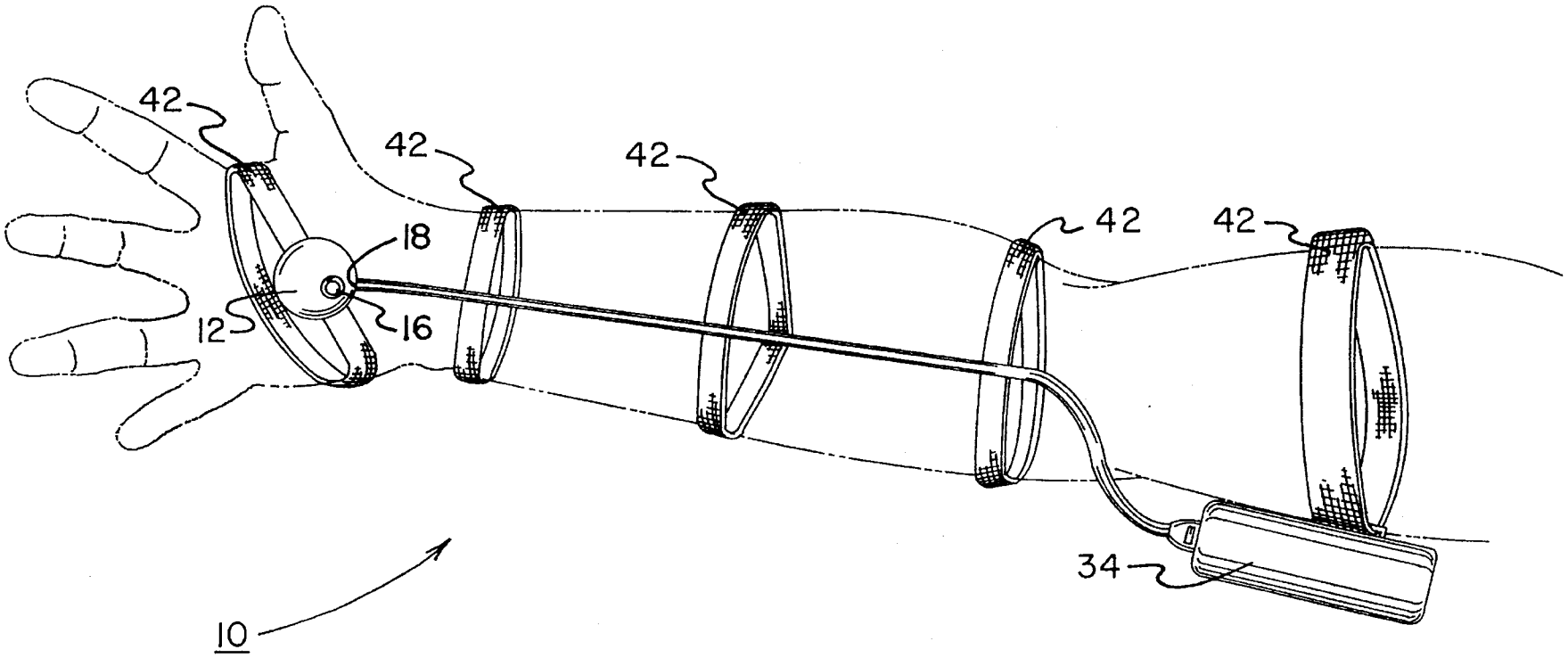
FIG. 1 is a perspective view of the preferred embodiment of the new and improved apparatus for spraying a disabling liquid at an attacker constructed in accordance with the principles of the present invention.
Figure 2:
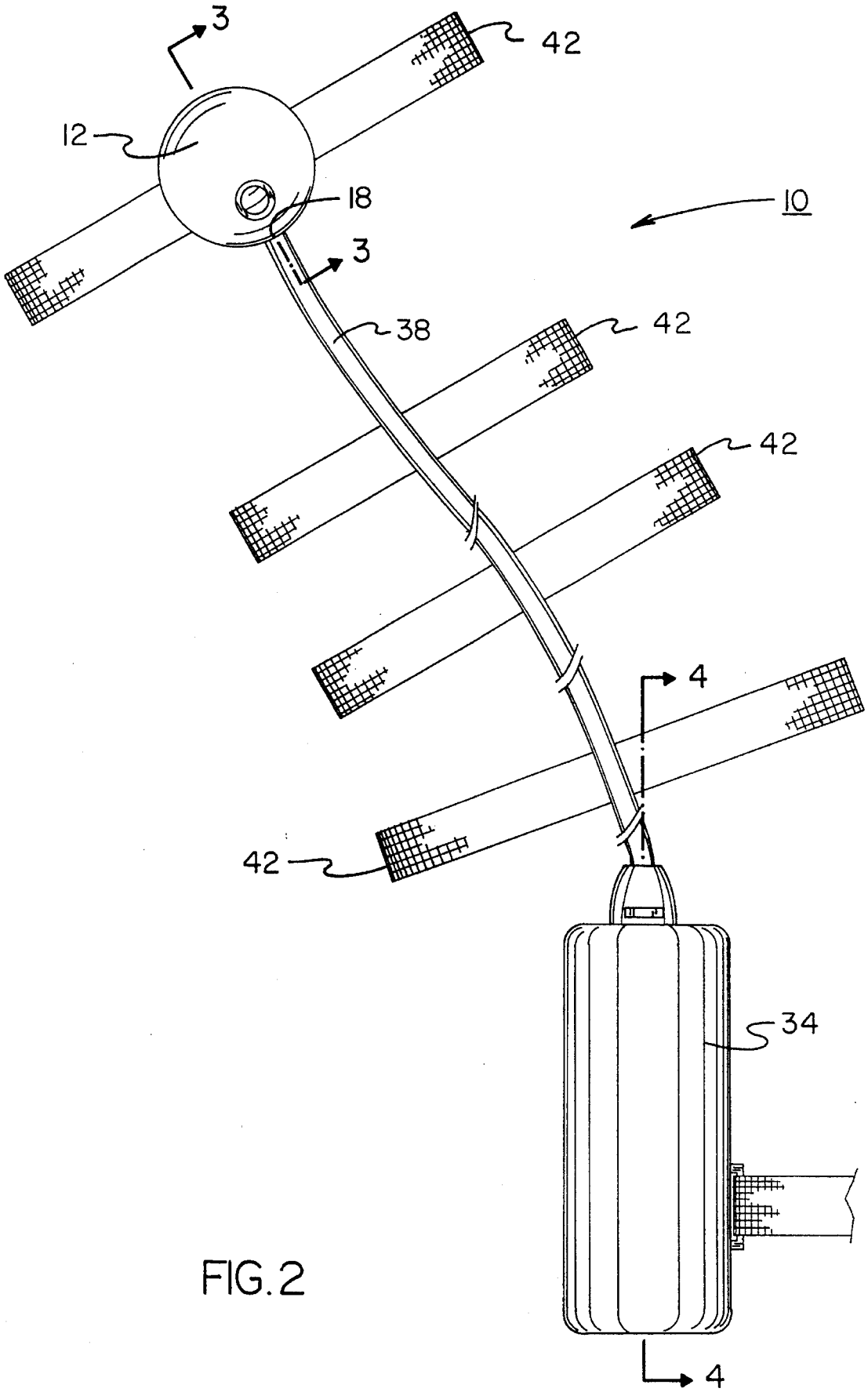
FIG. 2 is an enlarged perspective showing of the device of FIG. 1 but not mounted on a wearer.

With reference now to the drawings, and in particular to FIG. 1 thereof, the preferred embodiment of the new and improved apparatus for spraying a disabling liquid at an attacker embodying the principles and concepts of the present invention and generally designated by the reference numeral 10 will be described.

The present invention, the new and improved apparatus for spraying a disabling liquid at an attacker, is a system comprised of a plurality of components. Such components, in their broadest context, include a dispenser, a valve, a reservoir, a tube, disconnectable straps and a sliding gate valve. Such components are individually configured and correlated with respect to each other so as to attain the desired objective.

The central component of the system 10 of the present invention is a dispenser 12. Such dispenser is adapted for containing a quantity of liquid of the type capable of disabling an attacker if sprayed in the eyes or other face area. Such liquids are commercially available under a wide variety of brand names. The dispenser 12 has a hollow interior 14. It is in an oval configuration fabricated of an elastomeric material. Such material is preferably plastic or rubber, natural or synthetic, or blends thereof. It is resilient to return to its oval shaped configuration after the application of deforming forces are removed. The deforming forces tend to dispense the liquid and shoot it a distance from a discharge opening 16 formed in one side wall of the dispenser. In addition, the dispenser also includes an aperture 18 for the feeding of additional fluid into the dispenser.

Figure 3:
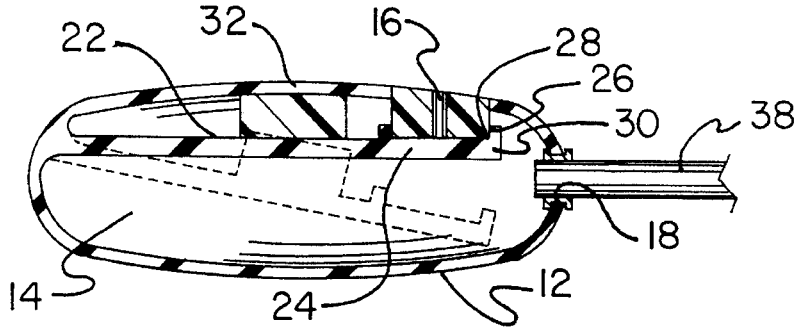
FIG. 3 is a cross-sectional view taken along line 3—3 of FIG. 2.
Figure 4:
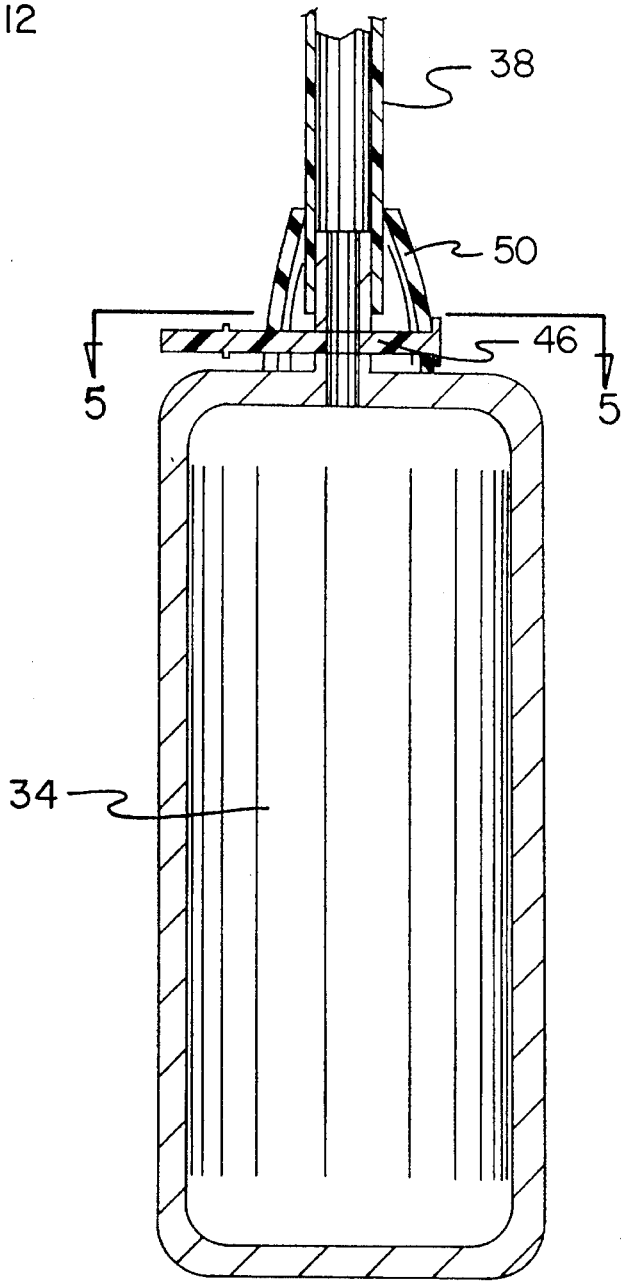
FIG. 4 is a cross-sectional view taken along line 4—4 of FIG. 2.
Figure 5:
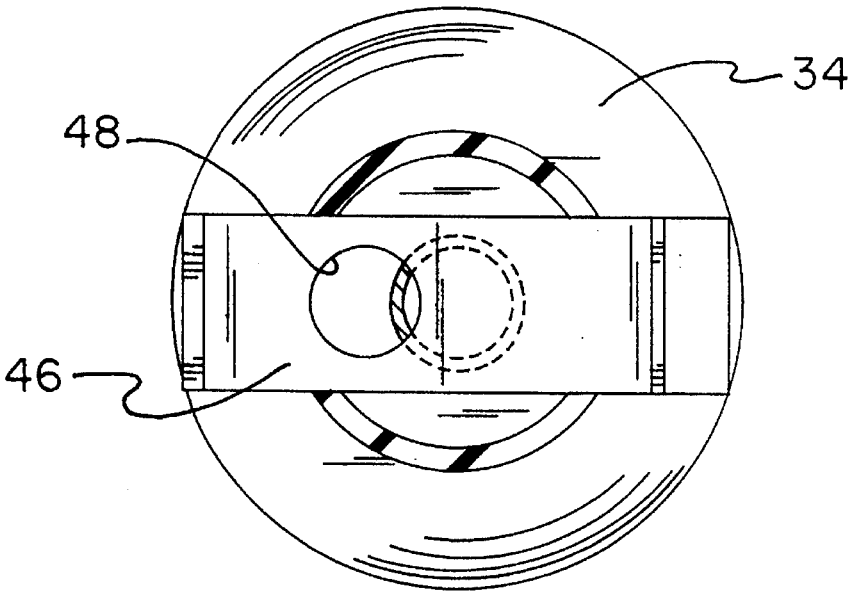
FIG. 5 is a cross-sectional taken along line 5—5 of FIG. 4.
Figure 6:
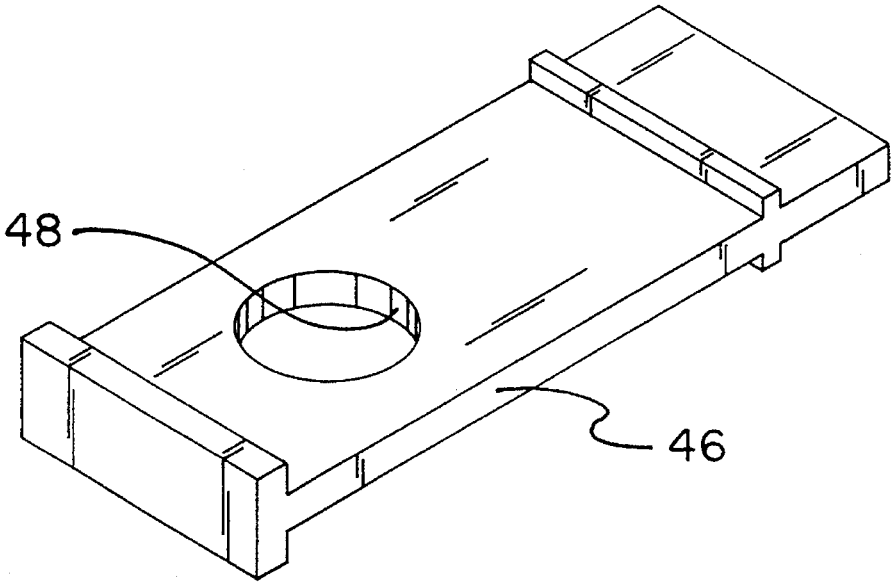
FIG. 6 is an enlarged perspective showing of the slide gate of FIG. 4.

Operable in association with the dispenser 12 and its opening 16 is a valve assembly 22. The valve assembly is located within the dispenser and includes a plate 24. The plate is positionable over the interior of the opening. The plate 24 includes adjacent surfaces 26, 28 on the plate and surrounding the opening which are adapted to frictionally retain the gate over the opening when in the closed position. Such is to frictionally retain the gate so as to preclude the dispensing of the liquid from the dispenser. The gate has a lock position shown in the solid line configuration of FIG. 3 wherein the plate functions as a gate positionable over the interior wall of the dispenser in proximity to the opening. The central part of the plate, however, is located adjacent to a block 32 secured with respect to the interior wall of the dispenser. Consequently, when the exterior surface of the wall adjacent to the block 32 is depressed, the plate will move away from the interior surface of the opening to allow the dispensing of fluid through the opening. Hinging of the plate is about its end remote from the opening where it is formed integrally with an adjacent portion of the interior wall of the dispenser.

The next component of the system is a reservoir 34 for containing additional fluid which is adapted to be supplied to the dispenser during operation and use. A tube 38 is formed of a flexible hollow material to couple the aperture 18 in the dispenser to the reservoir 34. The tube extends vertically with its upper end secured to the reservoir. The reservoir is adapted to be held at an upper extent of the user's arm. At the lower end, the tube is coupled to the dispenser normally carried at a lower orientation than the reservoir, specifically, in the palm of the hand of the user.

Disconnectable straps 42 are secured at an intermediate extent to spaced points along the length of the tube, as well as to the dispenser and to the reservoir. Such straps are, in the preferred embodiment, elastic bands to hold the tube in the proper orientation as well as to hold the reservoir and dispenser in the proper operative orientation as shown in FIG. 1.

Lastly provided is a sliding gate valve 46. The gate valve is provided with an aperture 48 extending therethrough. The gate valve is slidably supported within a housing 50 with its opposite ends secured to the adjacent ends of the tube and reservoir. As such, the coupling member has an aperture extending therethrough for allowing the flow of fluids from the reservoir through the housing and through the tube for refilling the dispenser. It is within this housing that gate 46 reciprocates at the interface between the reservoir and the tube. The gate is positionable in a first orientation wherein an appropriate section of the gate precludes the flow of fluid to and through the tube. In a second orientation, the aperture of the gate is in alignment with the tube and reservoir to allow the dispensing of fluid from the reservoir to the dispenser for reloading purposes.

A variety of self-protection devices are available for individuals and professionals such as police and security guards. Many of them share the same shortcoming. They are not instantly accessible to the person who carries them. Most of them are designed to be carried in a purse or pocket. This means that if the user is attacked, they must reach into the purse or pocket for the device before they can defend themselves with it. This may not be possible if the attacker grabs the victim or knocks them to the ground. The present invention is a new type of self-protection device which eliminates this problem.

The present invention is designed to be worn on the owner's arm instead of being kept in a pocket or purse. It consists of a Lycra pouch, elastic straps, a 2.5 ounce metal canister of capsicum, a trigger bladder, rubber grommets, and a plastic hose. The pouch holds the canister and is attached to the upper part of the arm with the elastic straps. The length of plastic hose extends from the canister spray head to the trigger bladder. Both the hose and trigger bladder are also secured to the arm and palm of the hand with elastic straps.

The present invention is easy to use. If the wearer is attacked, the spray can be dispensed toward the attacker by simply pressing the trigger bladder. As a safety precaution, the canister has a safety valve which can be turned off when the wearer does not think that it will be needed. In addition to its instant accessibility, the device also gives the wearer the benefit of surprise because it is concealed. When worn on the arm, the present invention provides the wearer with instant accessibility to a non-lethal, legal method of self-protection.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for spraying a disabling liquid at an attacker comprising, in combination:

a dispenser for a quantity of a liquid capable of disabling an attacker, the dispenser being fabricated in an oval configuration with a hollow interior containing a liquid and with a discharge opening formed in one side thereof, the dispenser also including an aperture for the feeding of additional fluid thereto;

a valve assembly located within the dispenser, the valve assembly including a plate positionable over the interior of the opening with adjacent surfaces adapted to frictionally retain a gate in position over the opening to preclude its dispensing, the plate functioning as the gate with the gate also having a lock positionable adjacent the interior wall of the dispenser in proximity to the opening whereby depressing of the center of the device of the dispenser adjacent the opening will move the lock to urge the gate away from the opening and thereby force fluid through the opening toward the attacker;

a reservoir of additional fluid;

a tube coupling the reservoir with the dispenser for supplying additional fluid from the reservoir to the dispenser;

disconnectable straps secured to the dispenser and to the reservoir and to the tube for removably coupling the reservoir tube and dispenser to the arm of a wearer with the reservoir adjacent the shoulder of a wearer and the dispenser in the hand of the wearer; and a sliding gate valve positioned in the flow of fluid adjacent to the interface between the reservoir and the tube, the gate valve positionable in a first orientation to preclude the flow of fluid through the tube and a second orientation wherein an aperture of the gate valve is in alignment with the tube to allow the dispensing of fluid from the reservoir to the dispenser.

2. An apparatus for spraying a disabling liquid at an attacker comprising:

a dispenser for a quantity of a liquid capable of disabling an attacker, the dispenser being fabricated in an oval configuration with a hollow interior containing a liquid and with a discharge opening formed in one side thereof, the dispenser also including an aperture for the feeding of additional fluid thereto;

a valve assembly located within the dispenser, the valve assembly having a plate positionable over the interior of the opening with adjacent surfaces adapted to frictionally retain a gate in position over the aperture to preclude its dispensing;

a reservoir of additional fluid;

a tube coupling the reservoir with the dispenser for supplying additional fluid from the reservoir to the dispenser; and disconnectable straps secured to the dispenser and to the reservoir for removably coupling the dispenser to the hand of a wearer and the reservoir to the arm of the wearer.

3. An apparatus for spraying a disabling liquid at an attacker comprising:

a dispenser for a quantity of a liquid capable of disabling an attacker, the dispenser having a hollow interior containing a liquid and with a discharge opening formed in one side thereof, the dispenser also including an aperture for the feeding of additional fluid thereto;

a valve assembly located within the dispenser, the valve assembly includes a plate positionable over the interior of the opening with adjacent surfaces adapted to frictionally retain a gate in position over the aperture to preclude its dispensing, the plate functioning as the gate with the gate also having a lock positionable adjacent the interior wall of the dispenser in proximity to the opening whereby depressing of the center of the device of the dispenser adjacent the opening will move the lock to urge the gate away from the opening and thereby force fluid through the opening toward the attacker;

a reservoir of additional fluid;

a tube coupling the reservoir with the dispenser for supplying additional fluid from the reservoir to the dispenser;

disconnectable straps secured to the dispenser and to the reservoir for removably coupling the reservoir to the arm of a wearer and the dispenser to the hand of the wearer; and a sliding gate valve positioned in the flow of fluid adjacent to the interface between the reservoir and the tube, the gate valve positionable in a first orientation to preclude the flow of fluid through the tube and a second orientation wherein an aperture of the gate valve is in alignment with the tube to allow the dispensing of fluid from the reservoir to the dispenser.

* * * * *